US009016066B2

(12) United States Patent
Wiebe et al.

(10) Patent No.: US 9,016,066 B2
(45) Date of Patent: Apr. 28, 2015

(54) COMBUSTOR ASSEMBLY IN A GAS TURBINE ENGINE

(71) Applicants: David J. Wiebe, Orlando, FL (US); Timothy A. Fox, Hamilton (CA)

(72) Inventors: David J. Wiebe, Orlando, FL (US); Timothy A. Fox, Hamilton (CA)

(73) Assignee: Siemens Energy, Inc., Orlando, FL (US)

( * ) Notice: Subject to any disclaimer, the term of this patent is extended or adjusted under 35 U.S.C. 154(b) by 223 days.

(21) Appl. No.: 13/718,297

(22) Filed: Dec. 18, 2012

(65) Prior Publication Data

US 2013/0174560 A1 Jul. 11, 2013

Related U.S. Application Data

(63) Continuation of application No. 12/431,302, filed on Apr. 28, 2009, now Pat. No. 8,375,726.

(60) Provisional application No. 61/099,695, filed on Sep. 24, 2008.

(51) Int. Cl.

| | |
|---|---|
| ***F23R 3/60*** | (2006.01) |
| ***F23R 3/04*** | (2006.01) |
| ***F23R 3/28*** | (2006.01) |
| ***F23R 3/00*** | (2006.01) |
| ***F23R 3/34*** | (2006.01) |

(52) U.S. Cl.

CPC ..... *F23R 3/286* (2013.01); *F23R 3/002* (2013.01); *F23R 3/34* (2013.01); *F23R 3/60* (2013.01); *F23R 3/346* (2013.01)

(58) Field of Classification Search

CPC ..... F02C 3/14; F02C 7/22; F02C 7/228; F23R 3/002; F23R 3/28; F23R 3/283; F23R 3/34; F23R 3/346; F23R 3/60

USPC ..... 60/800, 739, 752, 753, 754, 758, 760, 60/39.37

See application file for complete search history.

(56) References Cited

U.S. PATENT DOCUMENTS

| | | | | |
|---|---|---|---|---|
| 4,614,082 | A * | 9/1986 | Sterman et al. | 60/796 |
| 4,912,922 | A * | 4/1990 | Maclin | 60/796 |
| 5,323,600 | A | 6/1994 | Munshi | |
| 5,454,221 | A | 10/1995 | Loprinzo | |
| 5,630,320 | A | 5/1997 | Matsuda et al. | |
| 6,192,688 | B1 * | 2/2001 | Beebe | 60/723 |
| 6,869,082 | B2 | 3/2005 | Parker | |
| 6,895,757 | B2 * | 5/2005 | Mitchell et al. | 60/772 |
| 6,966,186 | B2 | 11/2005 | Bachovchin et al. | |
| 7,082,770 | B2 | 8/2006 | Martling et al. | |
| 7,249,461 | B2 | 7/2007 | Moraes | |
| 7,377,116 | B2 | 5/2008 | Parker et al. | |
| 2005/0050902 | A1 * | 3/2005 | Anichini et al. | 60/800 |

(Continued)

*Primary Examiner* — Andrew Nguyen

(57) ABSTRACT

A combustor assembly in a gas turbine engine includes a combustor device, a fuel injection system, a transition duct, and an intermediate duct. The combustor device includes a flow sleeve for receiving pressurized air and a liner surrounded by the flow sleeve. The fuel injection system provides fuel to be mixed with the pressurized air and ignited in the liner to create combustion products. The intermediate duct is disposed between the liner and the transition duct so as to define a path for the combustion products to flow from the liner to the transition duct. The intermediate duct is associated with the liner such that movement may occur therebetween, and the intermediate duct is associated with the transition duct such that movement may occur therebetween. The flow sleeve includes structure that defines an axial stop for limiting axial movement of the intermediate duct.

19 Claims, 3 Drawing Sheets

(56) References Cited * cited by examiner

U.S. PATENT DOCUMENTS

| | | | |
|---|---|---|---|
| 2010/0018208 | A1 | 1/2010 | Ritland et al. |
| 2010/0018209 | A1 | 1/2010 | Ramier et al. |
| 2010/0018210 | A1 | 1/2010 | Fox et al. |
| 2010/0071376 | A1 | 3/2010 | Wiebe et al. |

COMBUSTOR ASSEMBLY IN A GAS TURBINE ENGINE

CROSS REFERENCE TO RELATED APPLICATIONS

This application is a continuation of U.S. patent application Ser. No. 12/431,302, filed on Apr. 28, 2009, and entitled "COMBUSTOR ASSEMBLY IN A GAS TURBINE ENGINE," which claims the benefit of U.S. Provisional Patent Application Ser. No. 61/099,695, filed on Sep. 24, 2008, and entitled "DISTRIBUTED COMBUSTION STUB DUCT," the entire disclosures of which are incorporated by reference herein.

This invention was made with U.S. Government support under Contract Number DE-FC26-05NT42644 awarded by the U.S. Department of Energy. The U.S. Government has certain rights to this invention.

FIELD OF THE INVENTION

The present invention relates to a combustor assembly in a gas turbine engine and, more particularly, to a combustor assembly including an intermediate duct between a liner and a transition duct.

BACKGROUND OF THE INVENTION

A conventional combustible gas turbine engine includes a compressor, a combustor including a plurality of combustor assemblies, and a turbine. The compressor compresses ambient air. The combustor assemblies comprise combustor devices that mix the pressurized air with a fuel and ignite the mixture to create combustion products that define working gases. The working gases are routed to the turbine via a plurality of transition ducts. Within the turbine are a series of rows of stationary vanes and rotating blades. The rotating blades are coupled to a shaft and disk assembly. As the working gases expand through the turbine, the working gases cause the blades, and therefore the shaft, to rotate.

SUMMARY OF THE INVENTION

In accordance with a first aspect of the present invention, a combustor assembly is provided in a gas turbine engine comprising a main casing. The combustor assembly comprises a combustor device coupled to the main casing, a first fuel injection system, a transition duct, and an intermediate duct. The combustor device comprises a flow sleeve for receiving pressurized air and a liner surrounded by the flow sleeve and having an inlet, an outlet, and an inner volume. The first fuel injection system is associated with the flow sleeve for providing fuel that is adapted to be mixed with at least a portion of the pressurized air and ignited in the liner inner volume to create combustion products that define first working gases. The transition duct has an inlet section and an outlet section that discharges gases to a turbine section. The intermediate duct is upstream of the transition duct and has inlet and outlet portions. The intermediate duct is disposed between the liner and the transition duct so as to define a path for the first working gases to flow from the liner to the transition duct. The intermediate duct inlet portion is associated with the liner outlet such that movement may occur between the intermediate duct and the liner, and the intermediate duct outlet portion is associated with the transition duct inlet section such that movement may occur between the intermediate duct and the transition duct. The flow sleeve includes structure that defines an axial stop for limiting axial movement of the intermediate duct.

In accordance with a second aspect of the present invention, a combustor assembly is provided in a gas turbine engine comprising a main casing. The combustor assembly comprises a combustor device coupled to the main casing, a first fuel injection system, a transition duct, and an intermediate duct. The combustor device comprises a flow sleeve for receiving pressurized air and a liner surrounded by the flow sleeve and having an inlet, an outlet, and an inner volume. The first fuel injection system is associated with the flow sleeve for providing fuel that is adapted to be mixed with at least a portion of the pressurized air and ignited in the liner inner volume to create combustion products that define first working gases. The transition duct has an inlet section and an outlet section that discharges gases to a turbine section. The intermediate duct is upstream of the transition duct and has inlet and outlet portions. The intermediate duct is disposed between the liner and the transition duct so as to define a path for the first working gases to flow from the liner to the transition duct. The intermediate duct inlet portion is associated with the liner outlet such that movement may occur between the intermediate duct and the liner, and the intermediate duct outlet portion is associated with the transition duct inlet section such that movement may occur between the intermediate duct and the transition duct. The flow sleeve includes structure that defines a first axial stop for limiting axial movement of the intermediate duct, and the transition duct defines a second axial stop for limiting axial movement of the intermediate duct.

In accordance with a third aspect of the present invention, a combustor assembly is provided in a gas turbine engine comprising a main casing. The combustor assembly comprises a combustor device coupled to the main casing, a first fuel injection system, a transition duct, and an intermediate duct. The combustor device comprises a flow sleeve for receiving pressurized air and a liner surrounded by the flow sleeve and having an inlet, an outlet, and an inner volume. The first fuel injection system is associated with the flow sleeve for providing fuel that is adapted to be mixed with at least a portion of the pressurized air and ignited in the liner inner volume to create combustion products that define first working gases. The transition duct has an inlet section and an outlet section that discharges gases to a turbine section. The intermediate duct is upstream of the transition duct and has inlet and outlet portions. The intermediate duct is disposed between the liner and the transition duct so as to define a path for the first working gases to flow from the liner to the transition duct. The intermediate duct inlet portion is associated with the liner outlet such that movement may occur between the intermediate duct and the liner, and the intermediate duct outlet portion is associated with the transition duct inlet section such that movement may occur between the intermediate duct and the transition duct. The flow sleeve includes structure that defines a first axial stop for limiting axial movement of the intermediate duct, and the liner defines a second axial stop for limiting axial movement of the intermediate duct.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
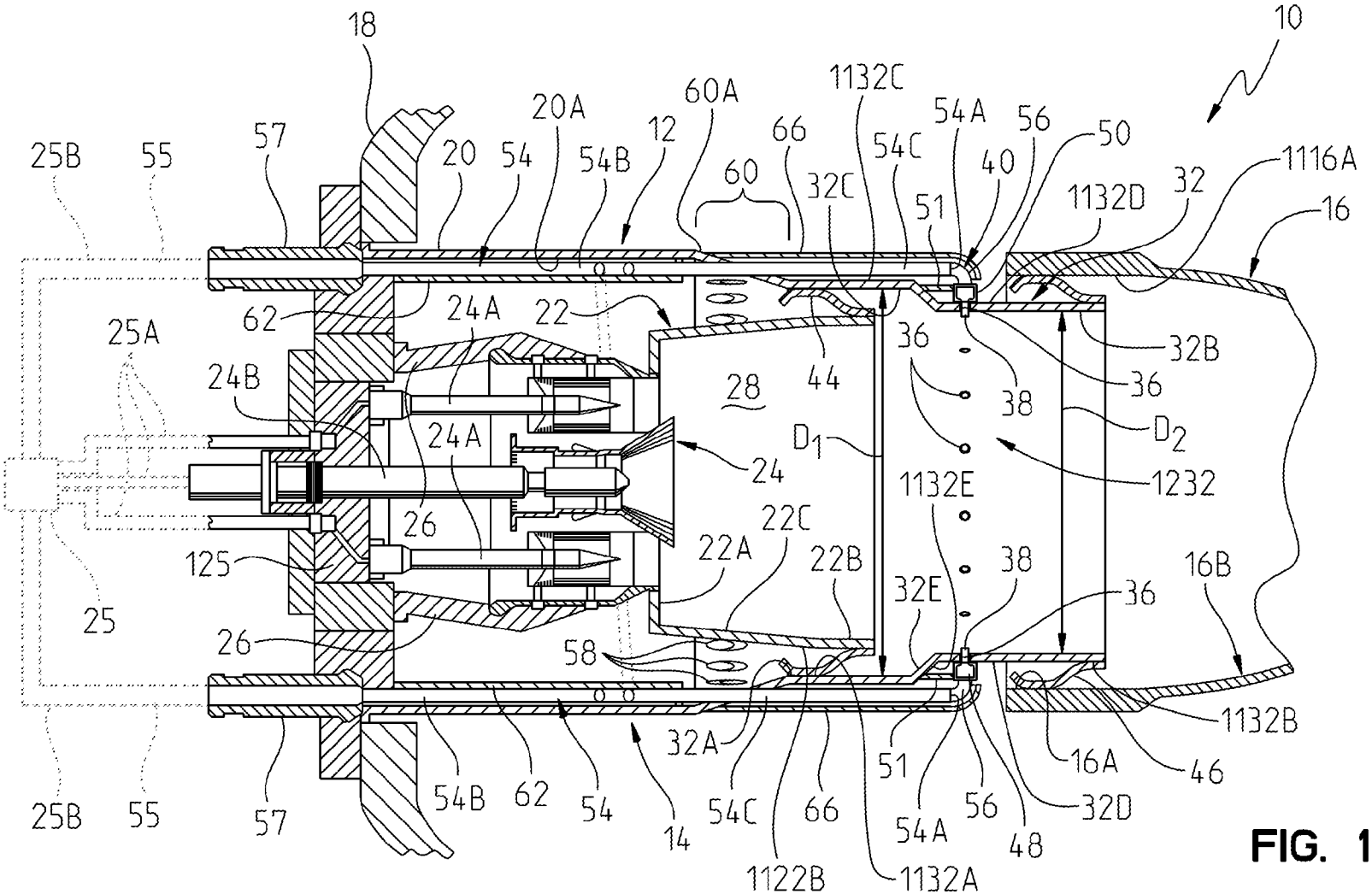
FIG. 1 is a side cross sectional view of a combustor assembly according to an embodiment of the invention.

Referring to FIG. 1, a portion of a can-annular combustion system 10 is shown. The combustion system 10 forms part of a gas turbine engine. The gas turbine engine further comprises a compressor (not shown) and a turbine (not shown). Air enters the compressor, which pressurizes the air and delivers the pressurized air to the combustion system 10. In the combustion system 10, the pressurized air from the compressor is mixed with a fuel at two locations in the illustrated embodiment to create air and fuel mixtures. The air and fuel mixtures are ignited to create hot combustion products that define working gases. The working gases are routed from the combustion system 10 to the turbine. The working gases expand in the turbine and cause blades coupled to a shaft and disk assembly to rotate.

The can-annular combustion system 10 comprises a plurality of combustor assemblies 12. Each combustor assembly 12 comprises a combustor device 14, a first fuel injection system 24, a second fuel injection system 40, a first fuel supply structure 25A, a second fuel supply structure 25B, a transition duct 16 and an intermediate duct 32. The combustor assemblies 12 are spaced circumferentially apart from one another.

Only a single combustor assembly 12 is illustrated in FIG. 1. Each combustor assembly 12 forming a part of the can-annular combustion system 10 can be constructed in the same manner as the combustor assembly 12 illustrated in FIG. 1. Hence, only the combustor assembly 12 illustrated in FIG. 1 will be discussed in detail herein.

The combustor device 14 comprises a flow sleeve 20 and a liner 22 disposed radially inwardly from the flow sleeve 20, see FIG. 1. The flow sleeve 20 is coupled to the main casing 18 of the gas turbine engine via a cover plate 125 and receives pressurized air therein from the compressor through inlet apertures 58 therein. The flow sleeve 20 may be formed from any material capable of operation in the high temperature and high pressure environment of the combustion system 10, such as, for example, stainless steel, and in a preferred embodiment may comprise a steel alloy including chromium.

The liner 22 is coupled to the cover plate 125 via support members 26 and at least partially defines a main combustion chamber 28. As shown in FIG. 1, the liner 22 comprises an inlet 22A, an outlet 22B and has an inner volume 22C. The liner 22 may be formed from a high-temperature material, such as HASTELLOY-X (HASTELLOY is a registered trademark of Haynes International, Inc.).

The first fuel injection system 24 may comprise one or more main fuel injectors 24A coupled to and extending axially away from the cover plate 125 and a pilot fuel injector 24B also coupled to and extending axially away from the cover plate 125. The first fuel injection system 24 may also be referred to as a "main," a "primary" or an "upstream" fuel injection system. The first fuel supply structure 25A is in fluid communication with a source of fuel 25 and delivers fuel from the source of fuel 25 to the main and pilot fuel injectors 24A and 24B. As noted above, the flow sleeve 20 receives pressurized air from the compressor through the flow sleeve inlet apertures 58. After entering the flow sleeve 20, the pressurized air moves into the liner inner volume 22C where fuel from the main and pilot fuel injectors 24A and 24B is mixed with at least a portion of the pressurized air in the liner inner volume 22C and ignited creating combustion products defining first working gases.

The transition duct 16 may comprise a conduit having a generally cylindrical inlet section 16A, an intermediate main section 16B, and a generally rectangular outlet section (not shown). A collar (not shown) is coupled to the conduit outlet section. The conduit and collar may be formed from a high-temperature capable material, such as HASTELLOY-X, INCONEL 617, or HAYNES 230 (INCONEL is a registered trademark of Special Metals Corporation, and HAYNES is a registered trademark of Haynes International, Inc.). The collar is adapted to be coupled to a row 1 vane segment (not shown) of the turbine.

The intermediate duct 32 is located between the liner 22 and the transition duct 16 so as to define a path for the first working gases to flow from the liner 22 to the transition duct 16. In the embodiment shown in FIG. 1, the intermediate duct 32 is integral with the flow sleeve 20, although it is understood that the intermediate duct 32 may be separately formed from the flow sleeve 20, as in the embodiments discussed below with reference to FIGS. 3 and 4. Because the intermediate duct 32 is integral with the flow sleeve 20, the flow sleeve 20 acts to locate the intermediate duct 32 axially. Further, the integral intermediate duct 32 and flow sleeve 20 decreases an axial length of the transition duct 16 and, hence, may reduce or eliminate any need for a flex support (not shown but commonly employed) to support the transition duct 16.

Figure 2:
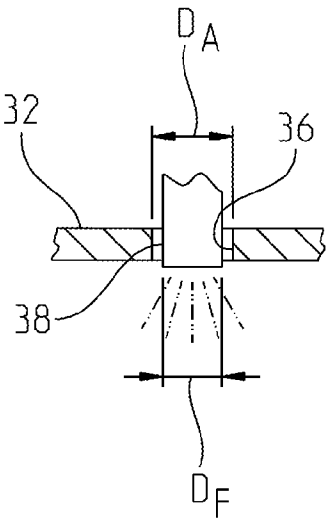
FIG. 2 is an enlarged cross sectional view illustrating a downstream fuel injector and a portion of an intermediate duct of the combustor assembly shown in FIG. 1.

A plurality of secondary fuel injection apertures 36 are formed in the intermediate duct 32, see FIGS. 1 and 2. The secondary fuel injection apertures 36 are each adapted to receive a corresponding downstream fuel injector 38 of the second fuel injection system 40. The second fuel injection system 40 may also be referred to as a "downstream" or a "secondary" fuel injection system. Additional details in connection with the second fuel injection system 40 will be described in greater detail below.

The intermediate duct 32 in the embodiment illustrated in FIG. 1 comprises a generally cylindrical inlet portion 32A, a generally cylindrical outlet portion 32B, first and second generally cylindrical mid-portions 32C and 32D, respectively, and an angled portion 32E joining the first and second mid-portions 32C and 32D to one another. The first generally cylindrical mid-portion 32C is proximate to the inlet portion 32A and the second generally cylindrical mid-portion 32D is proximate to the outlet portion 32B. In the embodiment shown, the angled portion 32E is located upstream from the secondary fuel injection apertures 36 and defines a transition between differing inner diameters of the first and second mid-portions 32C and 32D. Specifically, the angled portion 32E transitions between a first, larger inner diameter $D_1$ of the first generally cylindrical mid-portion 32C and a second, smaller inner diameter $D_2$ of the second generally cylindrical mid-portion 32D. The inlet portion 32A has the same inner diameter $D_1$ as the first generally cylindrical mid-portion 32C, while the outlet portion 32B has the same inner diameter $D_2$ as the second generally cylindrical mid-portion 32D. It is understood that the intermediate duct 32 may have a substantially constant diameter along its entire extent if desired, or the diameter $D_2$ of the second mid-portion 32D could be greater than the diameter $D_1$ of the first mid-portion 32C. Since the intermediate duct 32 is integral with the flow sleeve 20 in the FIG. 1 embodiment, it may be formed from the same materials noted above from which the flow sleeve 20 is formed.

The inlet portion 32A of the intermediate duct 32 is positioned over the liner outlet 22B, see FIG. 1. An outer diameter of the liner outlet 22B in the embodiment shown is smaller than the inner diameter $D_1$ of the intermediate duct inlet portion 32A. A contoured first spring clip structure 44 (also known as a finger seal) is provided on an outer surface 1122B of the liner outlet 22B and frictionally engages an inner surface 1132A of the intermediate duct inlet portion 32A such that a friction fit coupling is provided between the liner 22 and the intermediate duct 32. The friction fit coupling allows movement, i.e., axial, circumferential, and/or radial movement, between the liner 22 and the intermediate duct 32, which movement may be caused by thermal expansion of one or both of the liner 22 and the intermediate duct 32 during operation of the gas turbine engine. For example, relative movement caused, for example, by differences in thermal growth between the liner 22 and the intermediate duct 32 may create a force that overcomes the friction force provided by the first spring clip structure 44 such that substantially unconstrained axial movement occurs between the liner 22 and the intermediate duct 32. Alternatively, it is contemplated that the first spring clip structure 44 may be coupled to the inner surface 1132A of the intermediate duct inlet portion 32A so as to frictionally engage the outer surface 1122B of the liner outlet 22B.

In an alternative embodiment, the liner 22 and the intermediate duct 32 are generally coaxial and the first spring clip structure 44 is eliminated. In this embodiment, an inner diameter of the intermediate duct inlet portion 32A may be slightly larger than the outer diameter of the liner outlet 22B. Hence, the intermediate duct 32 may be coupled to the liner 22 via a slight friction fit or a piston-ring type arrangement. The intermediate duct angled portion 32E may also be eliminated, such that the intermediate duct 32 may comprise a substantially uniform inner diameter along generally its entire extent. In such an embodiment, relative movement caused, for example, by differences in thermal growth between the liner 22 and the intermediate duct 32 may create a force that overcomes the force provided by the friction fit or piston-ring type arrangement such that substantially unconstrained axial movement occurs between the liner 22 and the intermediate duct 32.

The inlet section 16A of the transition duct 16 is fitted over the intermediate duct outlet portion 32B, see FIG. 1. An outer diameter of the intermediate duct outlet portion 32B in the embodiment shown is smaller than an inner diameter of the transition duct inlet section 16A. A second contoured spring clip structure 46 is provided on an outer surface 1132B of the intermediate duct outlet portion 32B and frictionally engages an inner surface 1116A of the transition duct inlet section 16A such that a friction fit coupling is provided between the intermediate duct 32 and the transition duct 16. The friction fit coupling allows movement, i.e., axial, circumferential, and/or radial movement, between the intermediate duct 32 and the transition duct 16, which movement may be caused by thermal expansion of one or both of the intermediate duct 32 and the transition duct 16 during operation of the gas turbine engine. For example, relative movement caused, for example, by differences in thermal growth between the intermediate duct 32 and the transition duct 16 may create a force that overcomes the friction force provided by the second spring clip structure 46 such that substantially unconstrained axial movement occurs between the intermediate duct 32 and the transition duct 16. Alternatively, it is contemplated that the second spring clip structure may be coupled to the inner surface 1116A of the transition duct inlet section 16A so as to frictionally engage the outer surface 1132B of the intermediate duct outlet portion 32B.

Because the intermediate duct 32 is provided between the liner 22 and the transition duct 16 and the first and second spring clip structures 44 and 46 frictionally couple the liner 22 to the intermediate duct 32 and the intermediate duct 32 to the transition duct 16, two joints are defined along the axial path the working gases take as they move into the transition duct 16, i.e., where the intermediate duct 32 engages the liner 22 and the transition duct 16. These two joints accommodate axial, radial and/or circumferential shifting of the liner 22 and the transition duct 16 due to non-uniformity in temperatures in the liner 22, the transition duct 16 and structure mounting the liner 22 and the transition duct 16 within the engine casing.

As more clearly shown in FIG. 2, each fuel injector 38 of the second fuel injection system 40 extends through a corresponding one of the secondary fuel injection apertures 36 formed in the intermediate duct 32 so as to communicate with and inject fuel into an inner volume 1232 defined by the intermediate duct 32 at a location downstream from the main combustion chamber 28. The fuel injected by the fuel injectors 38 into the intermediate duct 32 mixes with at least a portion of the remaining pressurized air, i.e., pressurized air not ignited with the fuel supplied by the first injection system 24, and ignites with the remaining pressurized air to define further combustion products defining second working gases.

It is noted that injecting fuel at two axially spaced apart fuel injection locations, i.e., via the first fuel injection system 24 and the second fuel injection system 40, may reduce the production of NOx by the combustor assembly 12. For example, since a significant portion of the fuel, e.g., about 15-30% of the total fuel supplied by the first fuel injection system 24 and the second fuel injection system 40, is injected at a location downstream of the main combustion chamber 28, i.e., by the second fuel injection system 40, the amount of time that the second combustion products are at a high temperature is reduced as compared to first combustion products resulting from the ignition of fuel injected by the first fuel injection system 24. Since NOx production is increased by the elapsed time the combustion products are at a high combustion temperature, combusting a portion of the fuel downstream of the first combustion chamber 28 reduces the time the combustion products resulting from the second portion of fuel provided by the second fuel injection system 40 are at a high temperature, such that the amount of NOx produced by the combustor assembly 12 may be reduced.

The fuel injectors 38 may be substantially equally spaced in the circumferential direction, or may be configured in other patterns as desired, such as, for example, a random pattern. Further, the number, size, and location of the fuel injectors 38 and corresponding apertures 36 formed in the intermediate duct 32 may vary depending on the particular configuration of the combustor assembly 12 and the amount of fuel to be injected by the second fuel injection system 40.

As noted above, the second fuel injection system 40 comprises the fuel injectors 38. The second fuel injection system 40 further comprises a fuel dispensing structure 50, which, in the illustrated embodiment, comprises an annular manifold having an inner cavity 48. A plurality of support members 51 are coupled to and extend between the intermediate duct 32 and the fuel dispensing structure 50 so as to fixedly couple the fuel dispensing structure 50 directly to the intermediate duct 32.

The dispensing structure 50 communicates with the second fuel supply structure 25B so as to receive fuel from the second supply structure 25B. Fuel received by the fuel dispensing structure 50 is provided to the fuel injectors 38. The annular manifold defining the fuel dispensing structure 50 may extend completely or only partially around a circumference of the outer surface 1132D of the intermediate duct second mid-portion 32D.

As noted above, the second fuel injection system 40 receives fuel from the source of fuel 25 via the second fuel supply structure 25B. In the embodiment shown, the second fuel supply structure 25B comprises one or more, and preferably at least two, first fuel supply tubes 54. The first fuel supply tubes 54 are affixed to the fuel dispensing structure 50, for example, by welding, such that a fluid outlet 54A of each fuel supply tube 54 is in fluid communication with the cavity 48 via a corresponding fuel inlet portion 56 of the fuel dispensing structure 50, see FIG. 1. Second fuel supply tubes 55 extend from the fuel source 25 to a corresponding fitting 57, which, in turn, is coupled to and communicates with a corresponding first fuel supply tube 54. The first fuel supply tubes 54 are not directly coupled to the flow sleeve 20 and are only indirectly coupled to the intermediate duct 32 via the fuel dispensing structure 50.

Optionally, the first fuel supply tubes 54 may comprise a series of bends defining circumferential direction shifts to accommodate relative movement between each first fuel supply tube 54 and the intermediate duct 32, such as may result from thermally induced movement of one or both of the first fuel supply tubes 54 and the intermediate duct 32. Additional description of a fuel supply tube having circumferential direction shifts may be found in U.S. patent application Ser. No. 12/233,903, filed on Sep. 19, 2008, entitled "COMBUSTOR APPARATUS IN A GAS TURBINE ENGINE," the entire disclosure of which is incorporated herein by reference.

As shown in FIG. 2, a diameter $D_F$ of each of the fuel injectors 38 is slightly smaller than a diameter $D_A$ of the apertures 36 formed in the intermediate duct 32. Thus, an amount of movement due, for example, to thermal expansion, e.g., circumferential, axial, or tilting movement, is accommodated between the fuel injectors 38 and the intermediate duct 32.

As noted above, pressurized air enters the flow sleeve 20 through the inlet apertures 58. Those apertures 58 are formed in a conical shaped portion 60 of the flow sleeve 20.

As shown in FIG. 1, each first fuel supply tube 54 extends through a corresponding one of the inlet apertures 58.

A first cover structure 62 is coupled to the cover plate 125 and is positioned adjacent an inner surface 20A of the flow sleeve 20. Forward portions 54B of the first fuel supply tubes 54 are located between the flow sleeve inner surface 20A and the first cover structure 62. Hence, the first cover structure 62 and the flow sleeve 20 isolate the forward portions 54B of the first fuel supply tubes 54 from pressurized air flowing within the flow sleeve 20 by substantially preventing the pressurized air from contacting the first fuel supply tube forward portions 54B.

In addition to a forward portion 54B, each first fuel supply tube 54 further comprises an aft portion 54C, see FIG. 1. Each aft portion 54C is coupled, such as by welding, to a corresponding one of the fuel inlet portions 56 of the fuel dispensing structure 50. In the illustrated embodiment, a second cover structure 66 is coupled to the flow sleeve 20. The second cover structure 66 extends axially from the conical shaped portion 60 of the flow sleeve 20, over a section of an outer surface 60A of the conical shaped portion 60, outer surfaces 1132C and 1132E of the intermediate duct first mid-portion 32C and the intermediate duct angled portion 32E and a section of the outer surface 1132D of the intermediate duct second mid-portion 32D, to a location slightly beyond the second fuel injection system 40. The aft portions 54C of the first fuel supply tubes 54 are located between the second cover structure 66 and the conical shaped portion 60 and the intermediate duct 32. Hence, the second cover structure 66 and the conical shaped portion 60 and the intermediate duct 32 isolate the aft portions 54C of the first fuel supply tubes 54 from pressurized air flowing outside of the flow sleeve 20 by substantially preventing the pressurized air from contacting the aft portions 54C of the first fuel supply tubes 54.

It is noted that assembly of the combustor assembly 12 can be substantially performed outside of the main casing 18. For example, the flow sleeve 20, liner 22, intermediate duct 32, transition duct 16, and second fuel injection system 40 may be assembly and fitted together and then subsequently inserted as a unit into the main casing 18.

Figure 3:
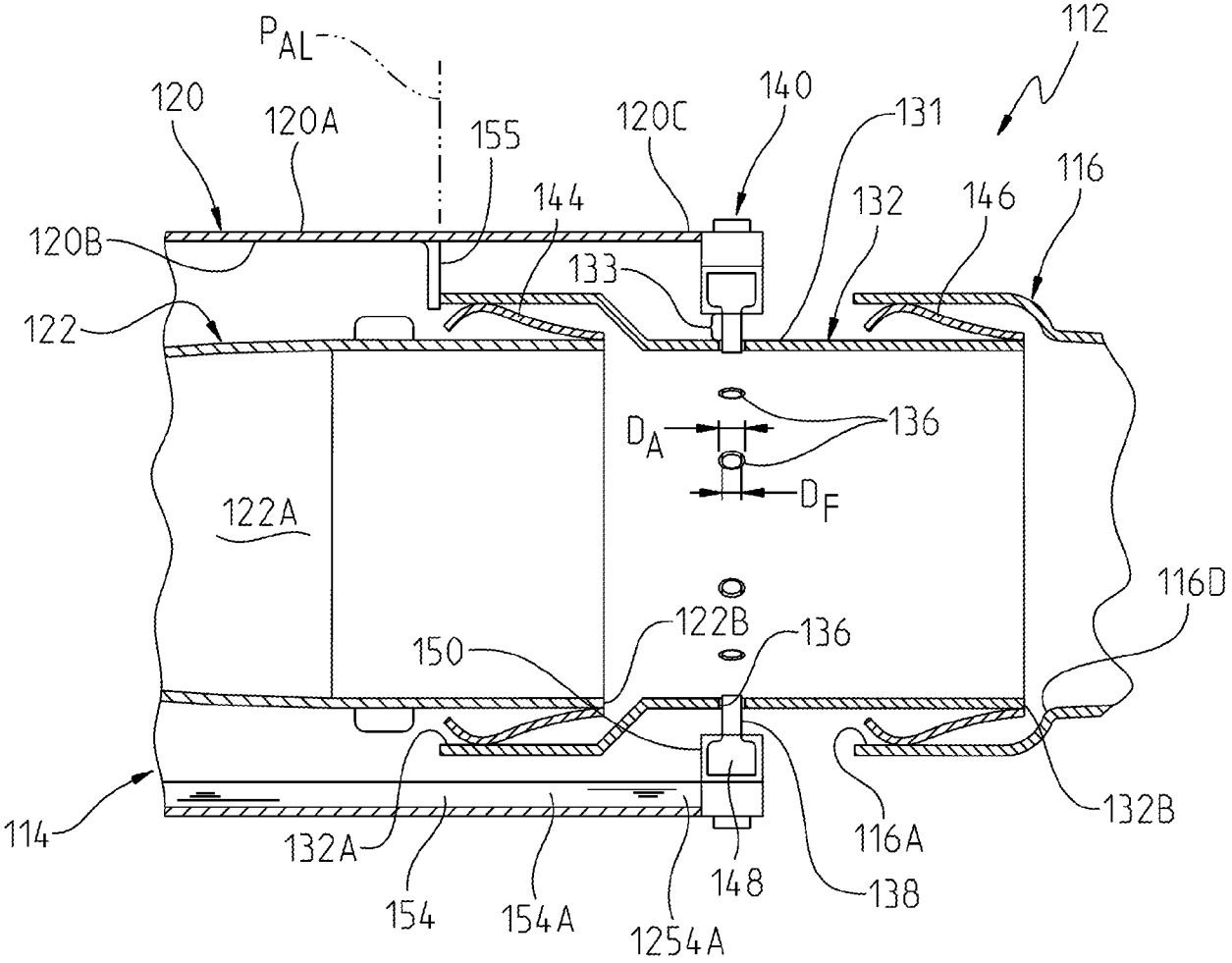
FIG. 3 is a side cross sectional view of a combustor assembly according to another embodiment of the invention.

Referring to FIG. 3, a combustor assembly 112 constructed in accordance with a second embodiment of the present invention and adapted for use in a can-annular combustion system of a gas turbine engine is shown. The combustor assembly 112 includes a combustor device 114, a first fuel injection system (not shown), a second fuel injection system 140, a first fuel supply structure (not shown), a second fuel supply structure 154, a transition duct 116 and an intermediate duct 132.

The combustor device 114 comprises a flow sleeve 120 and a liner 122 disposed radially inwardly from the flow sleeve 120. The flow sleeve 120 includes a radially outer surface 120A, a radially inner surface 120B, a forward end portion (not shown) coupled to a main casing (not shown) of the gas turbine engine via a cover plate (not shown) and an aft end portion 120C opposed from the forward end portion. The liner 122 is coupled to the main casing cover plate via support members (not shown) similar to support members 26 in the FIG. 1 embodiment.

The first fuel injection system (not shown) may comprise one or more main fuel injectors and a pilot fuel injector which are similar to the main and pilot fuel injectors 24A and 24B in the FIG. 1 embodiment. The main and pilot fuel injectors may be coupled to and extend axially away from the main casing cover plate. The first fuel supply structure, which may be similar in construction to the first fuel supply structure 25A illustrated in FIG. 1, may be in fluid communication with a fuel source (not shown) so as to provide fuel to the main and pilot fuel injectors. The flow sleeve 120 receives pressurized air from the compressor, which pressurized air moves into the liner 122. Fuel from the main and pilot fuel injectors is mixed with at least a portion of the pressurized air in an inner volume 122A of the liner 122 and ignited creating combustion products defining first working gases.

The transition duct 116 may comprise a transition duct similar to transition duct 16 illustrated in FIG. 1.

The second fuel injection system 140 is fixedly coupled to the flow sleeve aft end portion 120C. The radially inner surface 1208 of the flow sleeve 120 adjacent the aft end portion 120C forms, with a radially outer surface 131 of the intermediate duct 132, a gap 133 through which the pressurized air from the compressor enters into the flow sleeve 120.

The second fuel injection system 140 comprises a plurality of fuel injectors 138 and a fuel dispensing structure 150 having a cavity 148 therein. The cavity 148 receives fuel from the second fuel supply structure 154. In the embodiment shown, the second fuel supply structure 154 comprises one or more first fuel supply tubes 154A, only a single first supply tube 154A is illustrated in FIG. 3. The first fuel supply tubes 154A extend along the radially inner surface 1208 of the flow sleeve 120 and are affixed to the fuel dispensing structure 150, for example, by welding, such that a fluid outlet 1254A of each first fuel supply tube 154A is in fluid communication with the cavity 48, see FIG. 3. One or more second fuel supply tubes (not shown) extend from the fuel source (not shown) to a corresponding fitting (not shown), which, in turn, is coupled to and communicates with a corresponding first fuel supply tube 154A.

Optionally, the one or more first fuel supply tubes 154A may comprise a series of bends defining circumferential direction shifts to accommodate relative movement between the one or more first fuel supply tubes 154A and the flow sleeve 120, such as may result from thermally induced movement of the one or more first fuel supply tubes 154A and the flow sleeve 120.

As with the embodiment described above with reference to FIGS. 1 and 2, the fuel injectors 138 are adapted to deliver fuel from the cavity 148 into the intermediate duct 132. The fuel injectors 138 extend through a plurality of secondary fuel injection apertures 136 formed in the intermediate duct 132. A diameter $D_A$ of the apertures 136 may be slightly oversized with respect to a diameter $D_F$ of the fuel injectors 138.

In this embodiment, the intermediate duct 132 is separately formed from the flow sleeve 120 and is axially positioned between the liner 122 and a transition duct 116 so as to define a path for the first working gases to flow from the liner 122 to the transition duct 116. An inlet portion 132A of the intermediate duct 132 is located over an outlet 122B of the liner 122. A first spring clip structure 144 is coupled to liner outlet 122B and engages the intermediate duct inlet portion 132A so as to frictionally couple the liner outlet 122B to the intermediate duct inlet portion 132A, yet allow movement, i.e., axial, radial and/or circumferential movement, between the intermediate duct 132 and the liner 122.

One or more axial-movement restraint structures 155 (only one is shown in FIG. 3) extend radially inwardly from the radially inner surface 1208 of the flow sleeve 120 at a predefined axial location $P_{AL}$. The axial restraint structures 155 define a first axial stop for limiting axial movement of the intermediate duct 132, i.e., for preventing axial movement of the intermediate duct 132 beyond, i.e., axially forward from, the predefined axial location $P_{AL}$.

An outlet portion 1328 of the intermediate duct 132 is located radially inwardly from and is received by an inlet section 116A of the transition duct 116. A second spring clip structure 146 is coupled to intermediate duct outlet portion 132B and engages the transition duct inlet section 116A so as to frictionally couple the intermediate duct outlet portion 1328 to the transition duct inlet section 116A, yet allow movement, i.e., axial, radial and/or circumferential movement, between the intermediate duct 132 and the transition duct 116.

In this embodiment, the transition duct 116 may include a radially inwardly extending portion 116D at a predetermined axial location along the transition duct 116. The radially inwardly extending portion 116D defines a second axial stop for limiting axial movement of the intermediate duct 132, i.e., for preventing axial movement of the intermediate duct 132 beyond, i.e., axially downstream from, the predetermined axial location of the second axial stop of the transition duct 116.

The second fuel injection system 140 is not directly fixed to the liner 122 or the transition duct 116. Rather, the second fuel injection system 140 is coupled to the flow sleeve 120 and is permitted to float radially relative to the intermediate duct 132. As also noted above, the first spring clip structure 144 permits some amount of axial, radial and/or circumferential movement between the liner 122 and the intermediate duct 132, while the second spring clip structure 146 permits some amount of axial, radial and/or circumferential movement between the transition duct 116 and the intermediate duct 132. Accordingly, movement between the liner 122 and the intermediate duct 132 and between the intermediate duct 132 and the transition duct 116 caused, for example, by thermal expansion of one or more of the liner 122, the intermediate duct 132 and the transition duct 116 is permitted with low risk of binding between the liner 122, the intermediate duct 132 and/or transition duct 116. Further, little or no thermally induced stresses are applied to the second fuel injection system 140 by the liner 112, the intermediate duct 132 and/or the transition duct 116.

As an example, during operation of the combustion system, the first fuel supply tubes 154A and the second fuel injection system 140 may thermally expand and contract differently, i.e., a different amount, from that of the liner 122, the intermediate duct 132 and/or the transition duct 116. This may be because the fuel flowing through the first fuel supply tubes 154A and the second fuel injection system 140, which is cool relative to the working gases, functions to cool the first fuel supply tubes 154A and the second fuel injection system 140. Hence, during operation of the combustion system, the liner 122, the intermediate duct 132 and the transition duct 116 may reach much higher temperatures than the first fuel supply tubes 154A, the second fuel injection system 140, and the flow sleeve 120, which are not exposed to the working gases. Further, as the components may be made from different materials, the coefficients of thermal expansion of the materials forming the different components may differ. The different coefficients of thermal expansion and different operating temperatures may result in different rates and amounts of thermal expansion and contraction during combustion system operation and, hence, may contribute to differing amounts of thermal expansion and contraction between the components. Because the first fuel supply tubes 154A and the second fuel injection system 140 are not directly mounted to the liner 122, the intermediate duct 132 or the transition duct 116, thermally induced stresses caused by different rates and amounts of thermal expansion and contraction are not applied to the first fuel supply tubes 154A or the second fuel injection system 140 by the liner 122, the intermediate duct 132 and the transition duct 116.

Since the diameter $D_F$ of each of the downstream fuel injection system fuel injectors 138 is smaller than the diameter $D_A$ of the apertures 136 formed in the intermediate duct 132, a small amount of thermal expansion of either the fuel injectors 138 or the intermediate duct 132 may cause a small amount of relative movement, e.g., circumferential, axial, or tilting, between the fuel injectors 138 and the intermediate duct 132 without contact occurring between the fuel injectors 138 and the intermediate duct 132.

In this embodiment, since the intermediate duct 132 is separately formed from the flow sleeve 120 and is therefore not axially restrained by the flow sleeve 120, the axial restraint structures 155 and the radially inwardly extending portion 116D of the transition duct 116 retain the intermediate duct 132 in a generally desired axial location, i.e., between the axial restraint structures 155 and the radially inwardly extending portion 116D of the transition duct 116.

Figure 4:
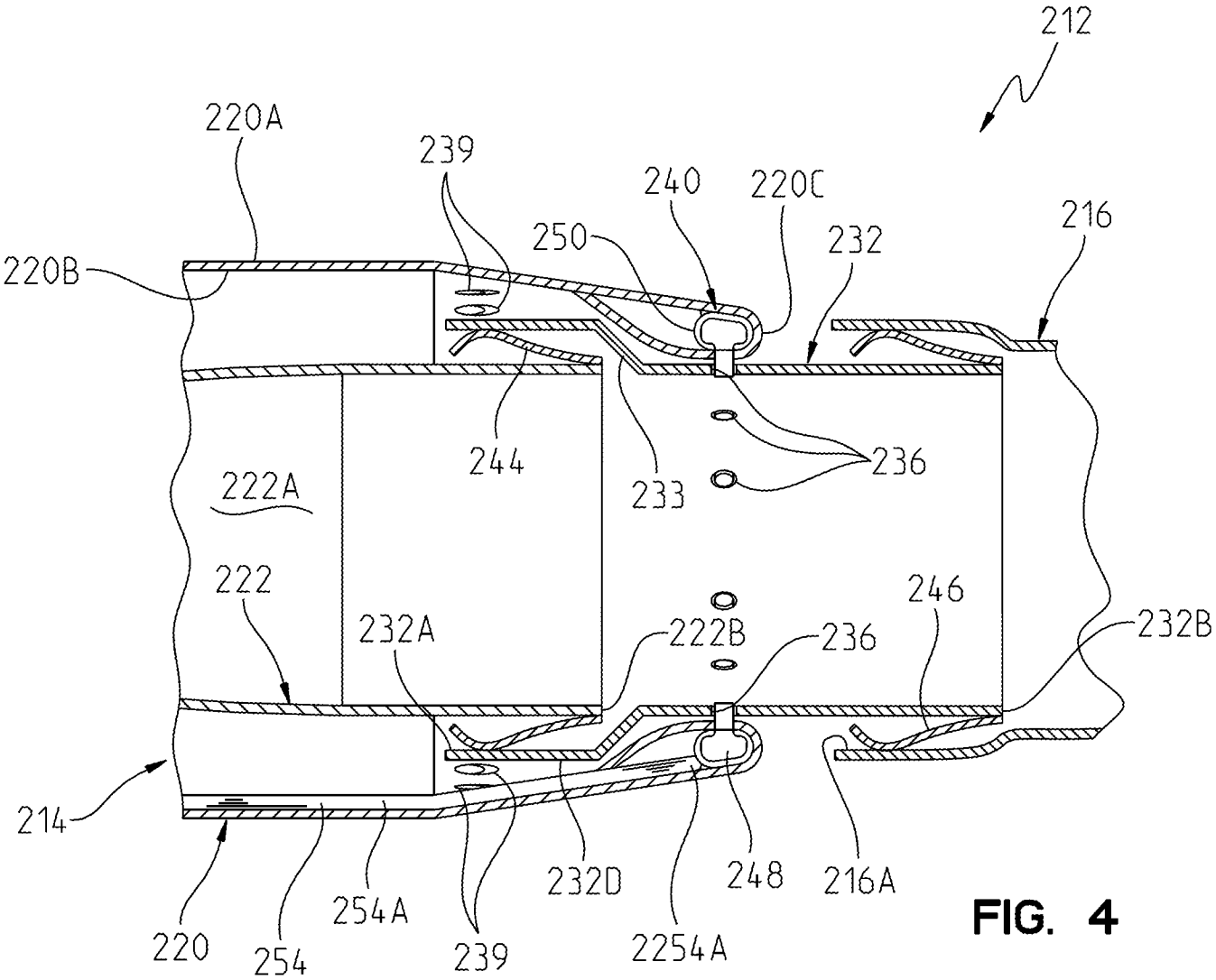
FIG. 4 is a side cross sectional view of a combustor assembly according to yet another embodiment of the invention.

Referring to FIG. 4, a combustor assembly 212 constructed in accordance with a third embodiment of the present invention and adapted for use in a can-annular combustion system of a gas turbine engine is shown. The combustor assembly 212 includes a combustor device 214, a first fuel injection system (not shown), a second fuel injection system 240, a first fuel supply structure (not shown), a second fuel supply structure 254, a transition duct 216 and an intermediate duct 232.

The combustor device 214 comprises a flow sleeve 220 and a liner 222 disposed radially inwardly from the flow sleeve 220. In this embodiment, the flow sleeve 220 includes a radially outer surface 220A, a radially inner surface 220B, a forward end portion (not shown) coupled to a main casing (not shown) of the gas turbine engine via a cover plate (not shown), and a looped aft end portion 220C opposed from the forward end portion. The liner 222 is coupled to the main casing cover plate via support members (not shown) similar to the support members 26 in the FIG. 1 embodiment.

The first fuel injection system (not shown) may comprise one or more main fuel injectors and a pilot fuel injector which are similar to the main and pilot fuel injectors 24A and 24B in the FIG. 1 embodiment. The main and pilot fuel injectors may be coupled to and extend axially away from the main casing cover plate. The first fuel supply structure, which may be similar in construction to the first fuel supply structure 25A illustrated in FIG. 1, may be in fluid communication with a fuel source (not shown) so as to provide fuel to the main and pilot fuel injectors. The flow sleeve 220 receives via openings 239 pressurized air from the compressor, which pressurized air moves into the liner 222. Fuel from the main and pilot fuel injectors is mixed with at least a portion of the pressurized air in an inner volume 222A of the liner 222 and ignited creating combustion products defining first working gases.

The transition duct 216 may comprise a transition duct similar to transition duct 16 illustrated in FIG. 1.

The second fuel injection system 240 is coupled to the flow sleeve 220. The second fuel injection system 240 comprises a plurality of fuel injectors 238 and a fuel dispensing structure 250 having a cavity 248 therein. The cavity 248 receives fuel from the second fuel supply structure 254. In the embodiment shown, the second fuel supply structure 254 comprises one or more first fuel supply tubes 254A, only a single first supply tube 254A is illustrated in FIG. 4. The first fuel supply tube 254A extends along the radially inner surface 220B of the flow sleeve 220 and is affixed to the fuel dispensing structure 250, for example, by welding, such that a fluid outlet 2254A of the fuel supply tube 254A is in fluid communication with the cavity 248, see FIG. 4. One or more second fuel supply tubes (not shown) extend from the fuel source (not shown) to a corresponding fitting (not shown), which, in turn, is coupled to and communicates with a corresponding first fuel supply tube 254A.

Optionally, the one or more first fuel supply tubes 254A may comprise a series of bends defining circumferential direction shifts to accommodate relative movement between the one or more first fuel supply tubes 254A and the flow sleeve 220, such as may result from thermally induced movement of the one or more first fuel supply tubes 254A and the flow sleeve 220.

The fuel injectors 238 are adapted to deliver fuel from the cavity 248 into the intermediate duct 232. The fuel injectors 238 extend through a plurality of secondary fuel injection apertures 236 formed in the intermediate duct 232. The apertures 236 may be slightly oversized with respect to the fuel injectors 238.

In this embodiment, the intermediate duct 232 is separately formed from the flow sleeve 220 and is positioned between the liner 222 and the transition duct 216 so as to define a path for the first working gases to flow from the liner 222 to the transition duct 216. An inlet portion 232A of the intermediate duct 232 is located over an outlet 222B of the liner 222. A first spring clip structure 244 is coupled to liner outlet 222B and engages the intermediate duct inlet portion 232A so as to frictionally couple the liner outlet 222B to the intermediate duct inlet portion 232A, yet allow movement, i.e., axial, radial and/or circumferential movement, between the intermediate duct 232 and the liner 222.

In this embodiment, a transitional portion 233 of the intermediate duct 232, which transitional portion 233 is between the intermediate duct inlet portion 232A and an outlet portion 232B of the intermediate duct 232, tapers radially inwardly. The tapering of the transitional portion 233 of the intermediate duct 232 generally corresponds to a radially inward taper of the aft end portion 220C of the flow sleeve 220. An axial location of the intermediate duct 232 is limited by where the liner outlet 222B engages an axial location on the intermediate duct transitional portion 233. The axial location of the intermediate duct 232 is further limited by where a radially outer surface 232D of the intermediate duct 232 contacts an inner surface of the flow sleeve looped end portion 220C, such that the intermediate duct 232 is prevented from moving axially downstream with respect to the flow sleeve 220. Hence, the flow sleeve aft end portion 220C defines a first axial stop for limiting axial movement of the intermediate duct 232 beyond the axial location of the first axial stop and the liner outlet 222B defines a second axial stop for limiting axial movement of the intermediate duct 232 beyond the axial location of the second axial stop.

An outlet portion 232B of the intermediate duct 232 is located radially inwardly from and is received by an inlet section 216A of the transition duct 216. A second spring clip structure 246 is positioned between the intermediate duct outlet portion 232B and the transition duct inlet section 216A and permits relative movement, i.e., axial, radial and/or circumferential movement, between the intermediate duct 232 and the transition duct 216.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combustor assembly in a gas turbine engine comprising a main casing, the combustor assembly comprising:

a combustor device coupled to the main casing comprising:

a flow sleeve coupled to said main casing for receiving pressurized air, wherein an aft end of said flow sleeve defines an air inlet that receives the pressurized air from a combustor plenum located about said combustor assembly; and a liner surrounded by said flow sleeve and having an inlet, an outlet, and an inner volume;

a first fuel injection system associated with said flow sleeve for providing fuel that is adapted to be mixed with at least a portion of the pressurized air and ignited in said liner inner volume to create combustion products that define first working gases;

a transition duct having an inlet section and an outlet section that discharges gases to a turbine section; and an intermediate duct upstream of said transition duct and having inlet and outlet portions and disposed between said liner and said transition duct so as to define a path for the first working gases to flow from said liner to said transition duct, wherein:

said intermediate duct inlet portion is associated with said liner outlet such that movement may occur between said intermediate duct and said liner;

said intermediate duct outlet portion is associated with said transition duct inlet section such that movement may occur between said intermediate duct and said transition duct; and said flow sleeve includes structure that defines an axial stop for limiting axial movement of said intermediate duct and wherein said air inlet is positioned about said intermediate duct.

2. A combustor assembly as set out in claim 1, further comprising a second fuel injection system comprising at least one fuel injector that injects fuel into said intermediate duct where the fuel injected by said at least one fuel injector mixes with remaining pressurized air and ignites to define further combustion products defining second working gases.

3. A combustor assembly as set out in claim 1, wherein said structure of said flow sleeve that defines said axial stop comprises at least one axial movement restraint structure that extends radially inwardly from said flow sleeve at a predefined axial location and prevents axial movement of said intermediate duct beyond said predefined axial location.

4. A combustor assembly as set out in claim 3, wherein said transition duct defines a second axial stop for preventing axial movement of said intermediate duct beyond an axial location of said second axial stop.

5. A combustor assembly as set out in claim 4, wherein said second axial stop is defined by a radially inwardly extending portion of said transition duct that contacts said outlet portion of said intermediate duct to prevent axial movement of said intermediate duct beyond the axial location of said second axial stop.

6. A combustor assembly as set out in claim 1, wherein said structure of said flow sleeve that defines said axial stop comprises a radially inwardly tapered portion of said flow sleeve that contacts a tapered transitional portion of said intermediate duct to prevent further axial movement of said transitional portion of said intermediate duct beyond said tapered portion of said flow sleeve.

7. A combustor assembly as set out in claim 6, wherein said liner defines a second axial stop for preventing axial movement of said intermediate duct beyond an axial location of said second axial stop.

8. A combustor assembly as set out in claim 7, wherein said second axial stop is defined by said outlet of said liner and contacts said transitional portion of said intermediate duct to prevent further axial movement of said transitional portion of said intermediate duct beyond the axial location of said second axial stop.

9. A combustor assembly as set out in claim 1, wherein a first spring clip structure is provided on one of said liner outlet and said intermediate duct inlet portion such that a friction fit coupling is provided between said liner and said intermediate duct and wherein a second spring clip structure is provided on one of said intermediate duct outlet portion and said transition duct inlet section such that a friction fit coupling is provided between said intermediate duct and said transition duct.

10. A combustor assembly as set out in claim 1, wherein said flow sleeve has an inner surface and said intermediate duct has an outer surface and pressurized air passes through a gap defined between said flow sleeve inner surface and said intermediate duct outer surface.

11. A combustor assembly in a gas turbine engine comprising a main casing, the combustor assembly comprising:

a combustor device coupled to the main casing comprising:

a flow sleeve coupled to said main casing for receiving pressurized air, wherein an aft end of said flow sleeve defines an air inlet that receives the pressurized air from a combustor plenum located about said combustor assembly; and a liner surrounded by said flow sleeve and having an inlet, an outlet, and an inner volume;

a first fuel injection system associated with said flow sleeve for providing fuel that is adapted to be mixed with at least a portion of the pressurized air and ignited in said liner inner volume to create combustion products that define first working gases;

a transition duct having an inlet section and an outlet section that discharges gases to a turbine section; and an intermediate duct upstream of said transition duct and having inlet and outlet portions and disposed between said liner and said transition duct so as to define a path for the first working gases to flow from said liner to said transition duct, wherein:

said intermediate duct inlet portion is associated with said liner outlet such that movement may occur between said intermediate duct and said liner;

said intermediate duct outlet portion is associated with said transition duct inlet section such that movement may occur between said intermediate duct and said transition duct;

said flow sleeve includes structure that defines a first axial stop for limiting axial movement of said intermediate duct; and said transition duct defines a second axial stop for limiting axial movement of said intermediate duct and wherein said air inlet is positioned about said intermediate duct.

12. A combustor assembly as set out in claim 11, wherein said second axial stop is defined by a radially inwardly extending portion of said transition duct that contacts said outlet portion of said intermediate duct to prevent axial movement of said intermediate duct beyond an axial location of said second axial stop.

13. A combustor assembly as set out in claim 12, wherein said structure of said flow sleeve that defines said first axial stop comprises at least one axial movement restraint structure that extends radially inwardly from said flow sleeve at a predefined axial location and prevents axial movement of said intermediate duct beyond said predefined axial location.

14. A combustor assembly as set out in claim 13, further comprising a second fuel injection system comprising at least one fuel injector that injects fuel into said intermediate duct where the fuel injected by said at least one fuel injector mixes with remaining pressurized air and ignites to define further combustion products defining second working gases.

15. A combustor assembly in a gas turbine engine comprising a main casing, the combustor assembly comprising:

a combustor device coupled to the main casing comprising:

a flow sleeve coupled to said main casing for receiving pressurized air, wherein an aft end of said flow sleeve defines an air inlet that receives the pressurized air from a combustor plenum located about said combustor assembly; and a liner surrounded by said flow sleeve and having an inlet, an outlet, and an inner volume;

a first fuel injection system associated with said flow sleeve for providing fuel that is adapted to be mixed with at least a portion of the pressurized air and ignited in said liner inner volume to create combustion products that define first working gases;

a transition duct having an inlet section and an outlet section that discharges gases to a turbine section; and an intermediate duct upstream of said transition duct and having inlet and outlet portions and disposed between said liner and said transition duct so as to define a path for the first working gases to flow from said liner to said transition duct, wherein:

said intermediate duct inlet portion is associated with said liner outlet such that movement may occur between said intermediate duct and said liner;

said intermediate duct outlet portion is associated with said transition duct inlet section such that movement may occur between said intermediate duct and said transition duct;

said flow sleeve includes structure that defines a first axial stop for limiting axial movement of said intermediate duct; and said liner defines a second axial stop for limiting axial movement of said intermediate duct and wherein said air inlet is positioned about said intermediate duct.

16. A combustor assembly as set out in claim 15, wherein said second axial stop is defined by said outlet of said liner and contacts said a tapered transitional portion of said intermediate duct to prevent further axial movement of said transitional portion of said intermediate duct beyond an axial location of said second axial stop.

17. A combustor assembly as set out in claim 16, wherein said structure of said flow sleeve that defines said first axial stop comprises a radially inwardly tapered portion of said flow sleeve that contacts said tapered transitional portion of said intermediate duct to prevent further axial movement of said transitional portion of said intermediate duct beyond said tapered portion of said flow sleeve.

18. A combustor assembly as set out in claim 17, further comprising a second fuel injection system comprising at least one fuel injector that injects fuel into said intermediate duct where the fuel injected by said at least one fuel injector mixes with remaining pressurized air and ignites to define further combustion products defining second working gases.

19. A combustor assembly as set out in claim 1, wherein said flow sleeve is coupled to said main casing via a cover plate that provides a direct coupling between said flow sleeve and said main casing.

* * * * *